United States Patent [19]

Moss et al.

[11] Patent Number: 4,678,307

[45] Date of Patent: Jul. 7, 1987

[54] DEVICE FOR PROCESSING EXPOSED PHOTOGRAPHIC FILM COILED ON A SPOOL

[75] Inventors: Brian F. Moss, Chelford; Richard J. Brent, Bramhall; Ian B. Pilkington, Prestbury, NR Macclesfield, all of England

[73] Assignee: Ciba-Geigy AG, Basel, Switzerland

[21] Appl. No.: 787,284

[22] Filed: Oct. 15, 1985

[30] Foreign Application Priority Data

Oct. 26, 1984 [GB] United Kingdom ..... 8427101

[51] Int. Cl.[4] ..... G03D 13/06

[52] U.S. Cl. ..... 354/313; 354/329; 354/337

[58] Field of Search ..... 354/307, 310, 312, 313, 354/314, 316, 329, 330, 323, 337, 341

[56] References Cited

U.S. PATENT DOCUMENTS

| | | | |
|---|---|---|---|
| 978,156 | 12/1910 | Hayden | 354/337 |
| 1,395,160 | 10/1921 | Stockwell | 354/313 |
| 2,078,579 | 4/1937 | Luz | 354/313 |
| 2,082,962 | 6/1937 | Lesjak et al. | 354/313 |
| 2,781,708 | 2/1957 | Perlin | 354/311 |
| 3,605,601 | 9/1971 | Okayama et al. | 354/335 |
| 3,703,859 | 11/1972 | Katsuragi | 354/313 |
| 4,001,857 | 1/1977 | Ikechi et al. | 354/313 |
| 4,134,666 | 1/1979 | Kikuchi | 354/329 |
| 4,171,055 | 10/1979 | Lindgren | 414/412 |
| 4,586,803 | 10/1984 | Moss et al. | 354/313 |

*Primary Examiner*—Mathews, A. A.
*Attorney, Agent, or Firm*—Harry Falber

[57] ABSTRACT

There is described a novel spiral-less film processing device for processing a roll of exposed film coiled on a spool which comprises a cylindrical light-right container of sufficient diameter and height to accommodate the film coiled on the spool, a light-tight lid to close the container, means attached to the internal wall of the container so located to engage with a sprocket hole in the film edge when the film is placed in the container and means connected with the spool for enabling the spool with the coiled film thereon to be rotated in either direction.

5 Claims, 8 Drawing Figures

FIG. 3
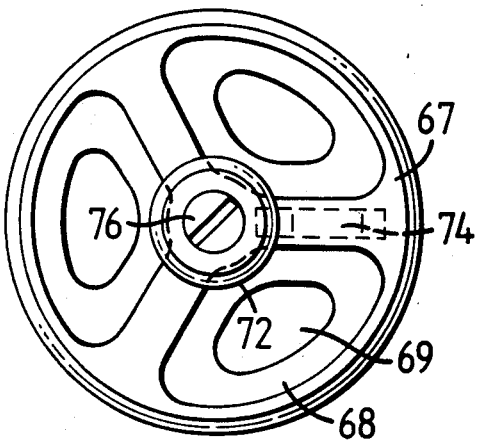
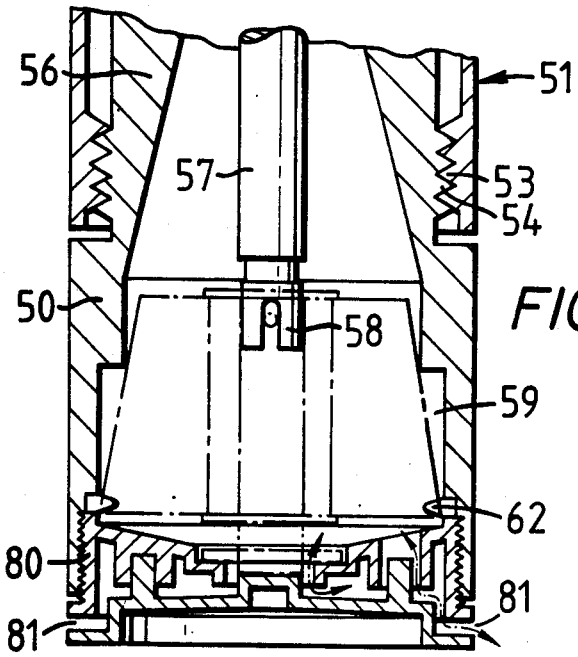
FIG. 4

FIG.5
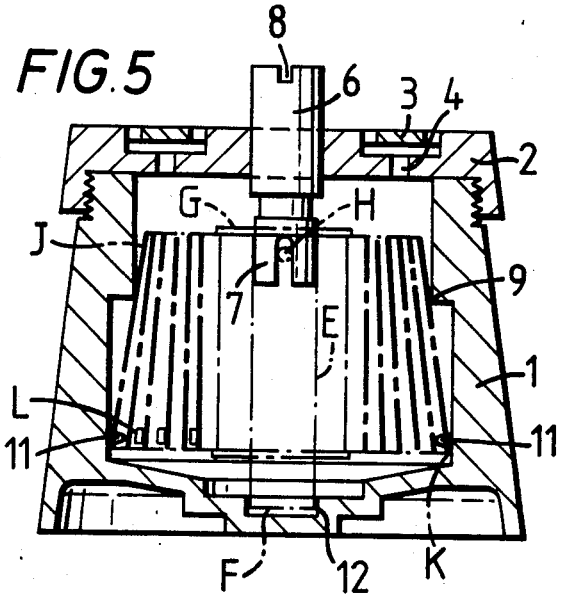
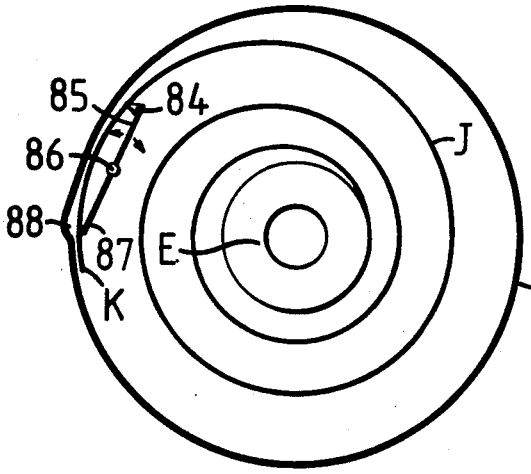
FIG.6

FIG. 7
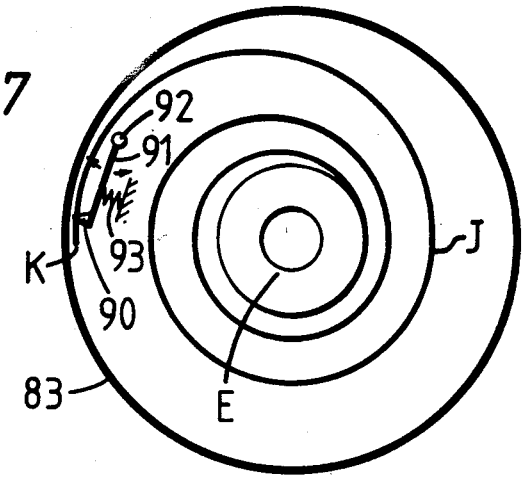
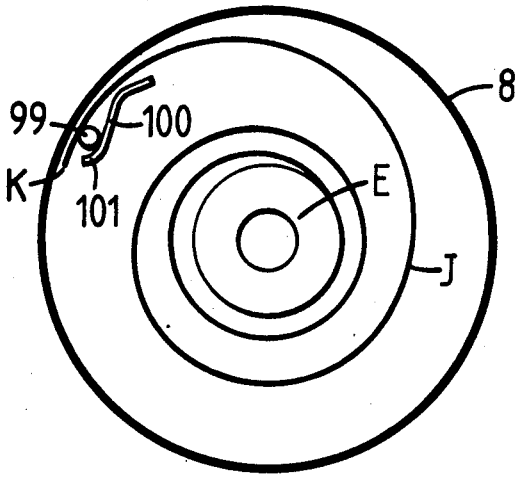
FIG. 8

DEVICE FOR PROCESSING EXPOSED PHOTOGRAPHIC FILM COILED ON A SPOOL

This invention relates to a processing device for exposed lengths of photographic film.

Most photographic films which are home processed or processed commercially in a small way are processed in a so-called spiral developing tank. To use such a tank the film is removed from the cassette and trimming its leading edge, this leading edge is inserted into the mouth of a spiral. The film is then worked into the spiral so that the whole length of film is held helically wound in the spiral. The spiral is placed in a light-tight container to which processing liquid can be added. All this must be carried out in almost complete darkness to avoid fogging the film. However, once the spiral holding the film has been placed in the light-tight container the various processing liquids can be placed in and removed from the container in daylight.

This is a well tried method but nevertheless photographers who are keen to process their own film find the threading of the spiral in the dark difficult to carry out satisfactorily. Often the film turns overlap as the film slips out of the guiding system. This causes uneven processing and frames are often ruined as a result. It is impossible to check if the film has been correctly wound into the spiral because of the light-less conditions. Thus the realisation of the difficulties of loading a spiral in the dark has dissuaded numbers of potential home processors from attempting to process their own films.

It is the object of the present invention to provide a processing device for exposed lengths of film which does not use a spiral but by means of which films can be very efficiently processed.

According to the present invention there is provided a device for processing a roll of exposed film coiled on a spool which comprises a cylindrical light-tight container of sufficient diameter and height to accommodate the film coiled on the spool, a light-tight lid to close the container, means attached to or adjacent to the internal wall of the container either so located to engage with a sprocket hole in the film edge or so formed to trap the leading end of the film when the film is placed in the container and means connected with the spool for enabling the spool with the coiled film thereon to be rotated in either direction.

In conventional processing devices, uniform processing is achieved by causing movement of the film bodily through the processing solutions or agitation of the solution as in a spiral processor so that fresh processing solution is continually brought into contact with the emulsion layer and the exhausted solution is washed off the surface. In the device of the present invention this requirement is met in an novel way in that the expanding and contracting film roll is used to create a pumping motion, thus providing a compact (i.e. low volume) and convenient processing device which nevertheless provides high quality results.

Preferably the sprocket hole engaging means or the film end trapping means is towards the bottom of the container and the container has internal flutes or steps to guide the leading edge of the film on the spool as it starts to uncoil towards the engaging means or trapping means so that the means engages a sprocket hole of the film or the film end is trapped.

Processing liquid may be provided in the container by placing the liquid in the container before the coiled film is placed therein or by introducing it therein afterwards.

This may be accomplished by pouring it through a specially constructed lid, by introducing it through a specially constructed base of the container or via a pipe above the liquid level which is formed in the side wall of the container.

The device of the present invention may be a simple container which is not significantly greater in height than the length of the spool on which the film is coiled or it may be part of a much bigger device in which provision is made to receive a cassette loaded with exposed film, the receiving area being located directly above the container in which the processing is carried out. In this case means are provided for forcing the film on the spool out of the cassette and into the liquid container part of the device. Preferably the film is forced out of the container by use of a plunger fitted to the lid of the device.

Most preferably in this case the end of the plunger is so designed that it readily engages the end of the spool in the cassette and subsequently retains it by virtue of an interference fit achieved by slight compression of the plunger tip.

Thus when the lower-most end cap of the cassette is forced off by the plunger the spool is still retained on the plunger as the plunger forces the spool with coiled film into the liquid container. The plunger when fully extended in the device can be rotated in both directions and preferably comprises an internal clutch so that it cannot be rotated beyond a limiting restraining force.

When the device of the present invention is a simple container preferably there is present in the lid, placed in the centre thereof a rotatable shaft to which the end of the spool can be engaged in an interference fit and which comprises externally means to rotate the shaft. Preferably as in the case of the plunger as just mentioned the central shaft includes an internal clutch so that during use the force which can be applied to the film is limited.

Thus when a sprocket hole has been engaged by the engaging means in the bottom of the container the plunger or shaft can be rotated so tending to coil up the film until the engaging means in the sprocket hole or the fact that the end of the film is trapped acts to restrain further coiling of the film.

The plunger or knob may then be rotated in the contra-direction to uncoil the film until the film retaining means on the spool acts to prevent further uncoiling of the film.

The rotation of the plunger or shaft first in one direction and then in the other provides a means for circulating the processing solution in the liquid container very evenly over the whole of the coil of film. Thus when the film is in the liquid container and a sprocket hole engaged or the end of the film trapped and processing liquid is either present in the container or is introduced therein, the plunger or shaft is rotated first in one direction and then in the other direction causing the film on the spool to coil and then uncoil. Considerable agitation of the liquid in the container is caused by this action and fresh processing solution is continuously pumped over the entire surface of the film in the container.

Automatic means may be connected to the external end of the plunger or shaft, that is to say the end of the plunger or shaft to which the spool is not attached, to cause the plunger or shaft to rotate first in one direction and then in the other direction until the processing step is complete.

In one embodiment the sprocket hole engaging means is at least one spike-like protrusion present on the internal wall of the container.

In another embodiment the sprocket hole engaging means is a pivoted barb or a spring-loaded barb.

In one embodiment the film end trapping means is a roller clutch.

The accompanying drawings will serve to illustrate the invention.

FIG. 3 is a horizontal top view of the device of FIG. 2.

FIG. 4 is a cross-sectional side elevation of the bottom half of a similar device to that shown in FIG. 2 but with a different liquid charging and discharging means.

FIG. 5 is a cross-sectional side elevation of a simple device according to the present invention.

FIG. 6 is a diagrammatic representation of a pivoted barb sprocket hole engaging means.

FIG. 7 is a diagrammatic representation of a spring-loaded barb sprocket hole engaging means.

FIG. 8 is a diagrammatic representation of a roller clutch film end trapping means.

The same parts of the cassette of FIG. 1 retain the same designations in all the figures.

Figure 2:
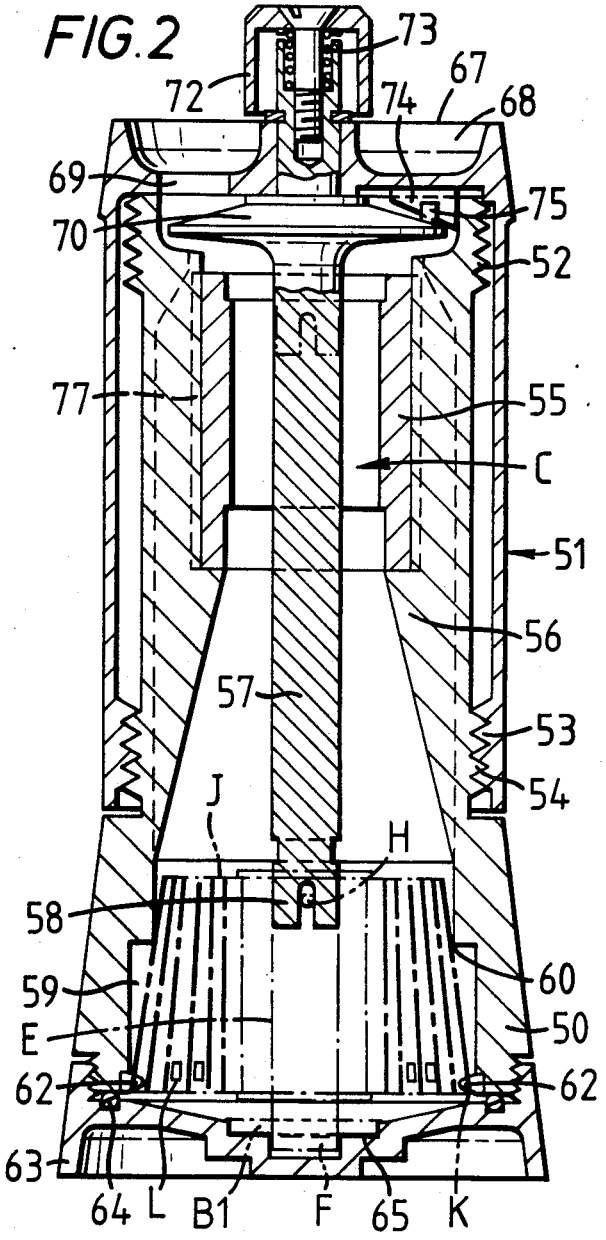
FIG. 2 is a cross-sectional side elevation of a device according to the present invention.

In FIGS. 2–4 the same members have the same signification.

Figure 1:
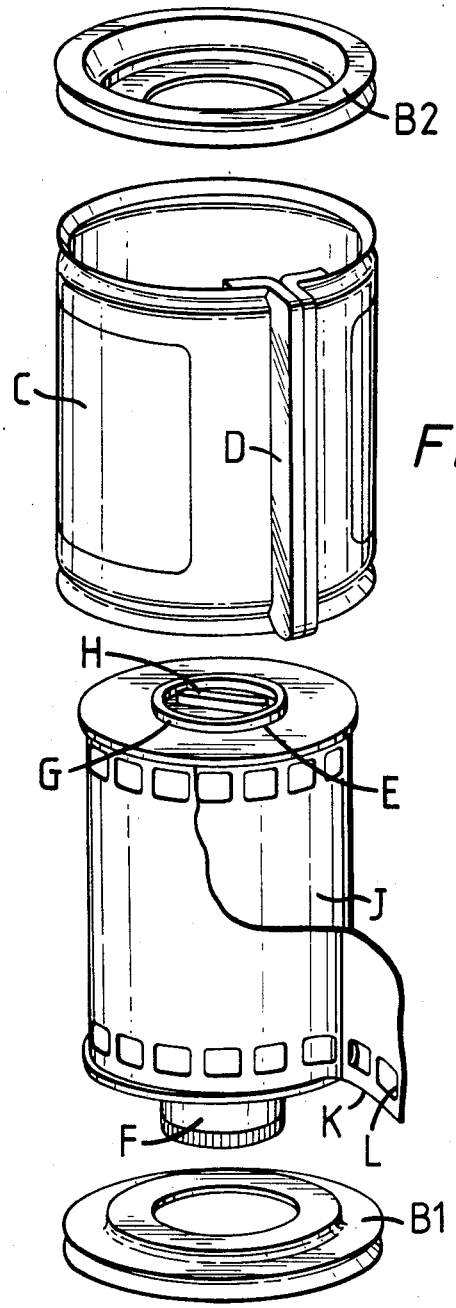
FIG. 1 is an exploded view of a 35 mm film cassette loaded with a length of film.

In FIG. 1 is shown a normal 35 mm film cassette which comprises two end caps B1 and B2 and a cassette body C and a film exit slot D which is formed by pinching together the two ends of the metal strip which form the cassette body C. When assembled there is present in the cassette body a spool E which has a long hub end F and a short hub end G. Located inwards of end G is an axial member H by use of which in a camera the film is wound either onto the spool or from the spool past the exposure chamber. The film is shown as J. The leading end of the film is shown as K and the sprocket holes as L.

The apparatus of FIG. 2 comprises a columnar body 50 onto which is fitted a lid 51.

The lid 51 is secured to begin with by its screw thread 53 which mates with the upper screw thread 52 on the body 50. After it has been screwed down past the screw thread 52 it mates with screw thread 54 on the body 50.

Present in the body 50 is a cassette retaining block 55 whch is held in position in the body 50 by vanes 56.

Attached by the lid 51 is a plunger 57 which has a resilient forked end 58 which fits over the axial member H in the spool E. An interference fit is formed so that the spool is retained on the end of the plunger 57 after the spool has been pushed out of the cassette body C. (Which is shown retained in the block 55).

The vanes 56 are shown to form a fluted array so enabling the film coiled on the spool to uncoil slightly as the spool is pushed out of the cassette body C.

Located in the body 50 below the fluted vanes 56 is the liquid container space 59. Encroaching into the space 59 the body 50 has been formed with a step 60. This step 60 aids in the fanning out of the leading end K of the film J.

Located towards the bottom of the liquid container space 59 are two spikes 62. These locate in the sprocket holes L of the film J as shown in the figure. The fanning out of the leading edge of the film ensures that the sprocket holes in the outermost coil of the film only are engaged by the spikes.

The liquid compartment 59 is closed by a removable base plate 63 which is sealed by an 'O' ring 64. The inside of the base plate 63 is shaped to receive the pushed-off end cap B1 through the central hole of which the hub end F of the spool protrudes and ensure that the pushed-off end cap B1 comes to rest as shown in FIG. 2.

The steps 65 in the base plate 63 provide a bearing support for the long hub end F.

The lid 51 on its upper surface 67 three cavities 68 (as shown in FIG. 2) which have a hole 69 at their bottom. These holes communicate with the inside of the body 50. A light baffle is provided by a flange 70 present on the plunger 57. The flange 70 prevents light from entering the body 50 via the holes 69.

Thus liquid can be poured via the cavities 68 and the holes 69 to fall through the body 50 via the cassette retaining block 55 into the liquid container 59, but no light is able to enter the apparatus past the flange 70.

Connected to the end of the plunger 57 remote from the split end 58 is a plunger rotating means 72. The plunger rotating means 72 is connected to the plunger 57 by a clutch 73.

Attached to the underside of the upper surface of the lid 67 is a raisable abutment member 74 which cooperates with a pin member 75 on the flange 70.

In FIG. 3 is shown the upper surface of the lid having therein the three cavities 68 at the bottom which are holes 69. The location of the plunger rotating means 72 is indicated. Present in the top of the plunger rotating means 72 is an axial member 76. Shown underneath the surface 67 is the abutment member 74.

In operation the end of an exposed film is wound fully into the cassette and the cassette is placed in the cassette retaining block 55.

The block 55 is then pressed into the body 50 of the apparatus so that the vanes 56 fit into the axial slots 77 and compress the block 55.

The forked end of the plunger is then fitted over the axial member H of the spool in the cassette to form an interference fit. Lid 51 is then screwed down onto the body 50 by the mating sets of screw threads 52 and 53. Initially until the abutment member 74 is disabled bringing into operation the clutch 73 the plunger is fixedly mounted in the lid 51.

Thus when the lid 51 is screwed down onto the body 50 the plunger 57 rotates and acts on the spool in the cassette forcing off the end cap B1. When the end cap is forced off the mating sets of screw threads continue to mesh until the coiled film leaves the cassette body C then the lid 51 is slid down body 50 until the screw threads 53 on the lid mesh with the lower set of screw threads 54 in the body 50. These sets of threads are engaged to stabilise the lid 51 on the body 50. When the threads 53 and 54 engage the plunger 57 is fully extended in the body of the cassette 50 and it still carries on its forked end 58 the spool of coiled film the leading end of which has started to fan out. Also at this stage the pin 75 is disengaged from the abutment member 74 by being raised out of contact therewith.

This enables the clutch mechanism 73 to come into operation and enables the plunger rotating means 72 to be rotated in either direction so rotating the plunger 57 to which the coiled film is attached.

The plunger 57 is then caused to rotate until the sprocket holes L are engaged by the spikes 62. The clutch has an overriding function so that once the edge of the film has been secured by the spikes further uncoiling of the film is prevented and the film is prevented from becoming coiled in the opposite sense. However, rotation of the plunger in the opposite direction enables the film to be coiled up until the force exerted by the spikes causes the clutch to prevent further rotation in this direction.

Thus the clutch allows the film on the spool to be coiled and uncoiled to a limited extent.

When the film has been positioned at the bottom of the body 50 a requisite quantity of processing liquid is poured into the liquid container 59 space of the body 50 via the holes 69 the amount of liquid being sufficient to cover the whole film on the spool.

At once the plunger is caused to rotate first in one direction and then in the other direction thus causing the film on the spool to coil and uncoil.

This movement of the film in the liquid pumps the liquid round the liquid container and ensures good agitation of the liquid over the surface of the film. This ensures very even processing of the film. After sufficient time for the processing step to be completed the apparatus is then inverted and the liquid empties out of the apparatus via the holes 69.

Another processing liquid can then be poured into the apparatus via the holes 69 and the plunger rotated as before to ensure even processing. Finally if required wash water can be poured into the apparatus.

After the last lot of liquid has been emptied out of the apparatus the removable base plate 63 is removed from the body 50 of the apparatus. The spool of film can then be removed from the apparatus.

A modification to the apparatus of the present invention is shown in FIG. 4.

The apparatus shown in FIG. 4 is exactly the same as the apparatus shown in FIG. 2 except that a different removable liquid container base plate is employed. In this case the removable base plate 80 comprises a complex labyrinth system of holes and light baffles 81. These are so arranged that when the apparatus of FIG. 4 is placed in a liquid bath liquid is able to enter the liquid container 59 to the height of the liquid in the bath. When the apparatus is lifted out of the bath all the liquid in the liquid container 59 flows out of the container.

Thus in operation a cassette is loaded into the apparatus and the film on the spool is pushed out of the cassette as described in connection with the apparatus of FIGS. 2 and 3. Then instead of pouring liquid via the holes 69 into the liquid container space 59 the apparatus is stood in a bath of processing liquid which contains a sufficient depth of liquid to cover the film on the spool in the liquid container.

The liquid then enters the liquid container space 59 to this depth. In this case the flange 70 and holes 69 act as light-shielded air vents.

The plunger is then rotated first in one direction and then in the other direction as is done with the apparatus of FIGS. 2 and 3.

After the processing step has been completed the apparatus is lifted out of the processing bath and the liquid empties out of the liquid container space 59 via the holes 81.

When all the liquid has stopped flowing out of the apparatus the apparatus can be stood in another bath of different processing liquid and the process repeated.

In FIG. 5 is shown a simple device according to the present invention.

The device of FIG. 5 comprises a container 1 having a lid 2 which screws down onto the container 1. The lid 2 comprises light-labyrinth 3 covering the liquid channels 4 through which processing liquid can be introduced into the container 1 or removed therefrom by inverting the container.

Mounted in the lid 2 is a knob 6 the lower end of which is forked. The upper end of the knob 6 has a groove 8 therein to which an automatic reciprocating device can be attached. The knob 6 comprises internally a clutch which prevents rotation when a force acting against rotation in either direction is exceeded.

The forked end 7 of the knob 6 fits over the axial member H on the spool E.

The film J is shown uncoiling on the spool E. The leading edge K of the film J has fanned out as the coiled film has passed the jutting out step portion 9 inside the container 1. Two sprocket holes L present in the leading end K of the film J have been penetrated by two spikes 11 mounted inside the container 1.

The long hub F of the spool E is located in a seat 12 formed at the bottom of the container 1.

In operation in the dark the coiled film J on the spool is removed from a cassette. The axial member H in the short hub G of the spool is then fitted into the forked member 7 of the knob 6, the lid 2 having been removed from the container 1. When the spool with the coiled film thereon is firmly fitted on the lid the lid 2 is screwed down on the container 1, care being taken to ensure that the film does not uncoil until the spool has entered into container 1 and that the long hub F is located in the seat 12.

The container 1 is then removed from the dark and the knob 6 turned until by feel it is ascertained that the sprocket holes L have been engaged by the spikes 11. Then the requisite amount of processing liquid is introduced into the container via the liquid channels 4. The knob 6 is then rotated either manually or automatically first in one direction until a resistance is encountered and then in the other direction until a resistance is encountered. This action causes the processing liquid to become automatically agitated by the film being moved in and out in the liquid and fresh processing liquid is constantly caused to flow over the surface of the film.

When the time for the processing step has elapsed the processing liquid is removed from the container by inverting it and allowing the liquid to flow out of the liquid channels 4. Fresh processing liquid is then introduced into the container via the channels and the knob 6 is then rotated as before.

After the processing steps have been completed the lid 2 is unscrewed from the container 1 and the coiled film on the spool is taken off the lid and the film water washed.

In FIGS. 6, 7 and 8 a cross-section is shown through the liquid container part of the device to show diagramatically the sprocket-hole engaging means or the film end trapping means which can replace the spikes 62 in FIGS. 2–4 and spikes 11 in FIG. 5.

In each case with the sprocket hole engaging means or the film end trapping means is located towards the end of the liquid container 83 of the device of the present invention.

In each case the film J is shown uncoiling on the spool E.

In FIG. 6 a barb 84 is mounted on the end of a lever 85 which is pivotted at 86. The end 87 of the lever 85 is located in a recess 88 in the inner wall of the container 83.

The leading end of the film K pushes past the end 87 of the lever 85 as the coiled film J unwinds. This causes the lever 85 to pivot and forces the barb against the edge of the film where it engages one of the sprocket holes.

In FIG. 7 a barb 90 is mounted on a lever 91 which is pivotted at 92. A spring 93 pushes the barb 90 towards the inside wall of the container 83. When the end K of the uncoiling film J pushes past the spring loaded barb 90 the barb engages one of the sprocket holes in the film end.

In FIG. 8 a film end trapping means is shown. This comprises a roller 99 and a fixed member 100. The roller 99 is free to roll but is trapped in one direction by the inclined plane of the member 100 and in the other direction by the curved end 101 of the member 100.

As the end K of the uncoiling film J pushes past the roller 99 the roller is pushed to the curved end 101. However, when the film J is caused to coil-up during the processing sequence the end K forces the roller 99 into the inclined plane formed by the fixed member 100 and the internal wall of the container. This traps the end K of the film and thus prevent the film from becoming fully coiled up.

What is claimed is:

1. A device for processing a roll of exposed film coiled on a spool which comprises a cylindrical light-tight container of sufficient diameter and height to accomodate the film coiled on the spool, a light-tight lid to close the container, barb means attached to or adjacent to the internal wall of the container so located to retain the film when the film is placed in the container and means connected with the spool for enabling the spool with the coiled film to be rotated in either direction.

2. A device according to claim 1 wherein the barb means is located towards the bottom of the container and the container has internal flutes or steps to guide the leading edge of the film on the spool as it starts to uncoil towards the barb means.

3. A device according to claim 1 wherein the barb means is a pivotted barb.

4. The device of claim 1, wherein the barb means is a spring-loaded barb.

5. A light-tight processing device for a film coiled on a spool which comprises means to receive a cassette loaded with a length of exposed film, a light-tight container in which the film on the spool is processed located directly below the means to receive the loaded cassette, a plunger for forcing the film on the spool out of the cassette and into the light-tight container, the end of the plunger comprising means to engage the end of the spool and to retain it, means to enable the plunger to be rotated in either direction when fully extended in the said light-tight container, the said light-tight container consisting of a cylindrical container of sufficient diameter and height to accomodate the film coiled on the spool attached to the plunger and barb means to enable fixed retention of the loading end of the film in proximity to the wall of the container.

* * * * *